United States Patent [19]

Guenard

[11] Patent Number: 4,781,093

[45] Date of Patent: Nov. 1, 1988

[54] MULTI-POWER CUTTER

[76] Inventor: Edward F. Guenard, 1089 Kerwan Avenue, Coquitlam, British Columbia, Canada, V3J 2J9

[21] Appl. No.: 885,076

[22] Filed: Jul. 14, 1986

[51] Int. Cl.[4] ..... B26D 3/16; B26D 7/02

[52] U.S. Cl. ..... 83/176; 83/54; 83/375; 83/455; 83/464; 83/466.1

[58] Field of Search ..... 83/54, 19, 176, 54, 83/380, 455, 464, 466.1, 375, 925 EB

[56] References Cited

U.S. PATENT DOCUMENTS

| | | | |
|---|---|---|---|
| 2,190,049 | 2/1940 | Sperry | 83/455 |
| 2,539,372 | 1/1951 | Metzler | 83/54 X |
| 3,657,951 | 4/1972 | Clark | 83/54 |
| 3,754,428 | 8/1973 | Alexoff | 83/54 X |
| 3,756,108 | 9/1973 | Fuchs, Jr. | 83/54 X |
| 3,863,538 | 2/1975 | Behnke | 83/54 X |
| 3,978,747 | 9/1976 | Lyon | 83/54 X |
| 4,015,496 | 4/1977 | Hill | 83/466.1 |
| 4,212,215 | 7/1980 | Buys | 83/466.1 X |
| 4,579,027 | 4/1986 | Lewis | 83/925 EB X |
| 4,589,314 | 5/1986 | Ralph et al. | 83/375 X |
| 4,625,364 | 12/1986 | Adams | 83/466.1 X |

*Primary Examiner*—Frank T. Yost

*Attorney, Agent, or Firm*—Fetherstonhaugh & Co.

[57] ABSTRACT

This invention discloses an apparatus for cutting tubular objects such as rubber hoses and the like. It comprises a cutting blade movably positioned within a main body and includes a first and second actuator. A retainer is used to hold the tubular object before the cutting blade. The first actuator is secured to the cutting blade and the second to the retainer. Upon securing a tubular object in said retainer, the first actuator is activated thereby allowing the cutting blade to sever the object.

7 Claims, 3 Drawing Sheets

MULTI-POWER CUTTER

This invention relates to cutters and more particularly to cutters able to cut tubular objects such as hoses, pipes and the like.

An area of prime concern with bulk handlers and major distributors or end users of hoses and hose materials, is the task of cutting hoses to a predetermined length. At the present time, hoses are cut by using either a knife or a hacksaw in which case a very uneven cut can result, many times with shredded inner and outer surfaces which can sometimes be on an unacceptable angle.

In most instances, when an individual attempts to cut a hose he must use one hand to hold that hose which is to be cut and the other hand to hold the knife or hacksaw. Not only is this method dangerous but also a flexible hose would not withstand the pressures being applied and consequently the hose totally collapses.

It is therefore an object of the present invention to provide a multi-cutter which will render the cutting of flexible hoses quick and safe.

Another object of the present invention is to provide a cutter which will grip the flexible hose and collapse it in a vice-like manner to allow a cutting blade to cut the collapsed hose transversely.

Yet another of the present invention is to provide a cutter able to grip and cut a flexible hose without the need of additional tools.

Accordingly, there is provided an apparatus adapted for cutting tubular objects comprising a main body; cutting means movably positioned within said body; first actuating means secured to said cutting means; retaining means adapted to hold said objects before said cutting means; second actuating means to permit positioning and removal of said objects from said retaining means such that upon securing said objects within said retaining means, said first actuating means can be activated thereby allowing said cutting means to severe said object.

Particular embodiments of the invention will be understood in conjunction with the accompanying drawings in which.

Figure 3:
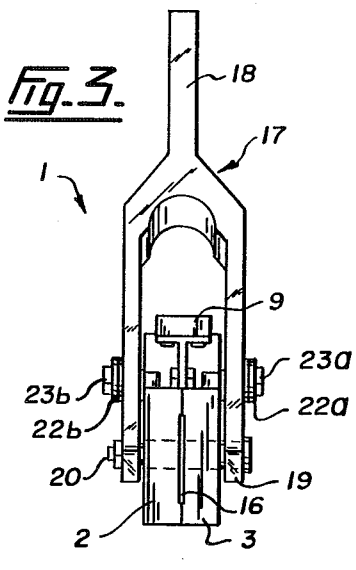
FIG. 3 is a right side view.

Referring now to FIGS. 1, 2, 3 and 5, there is shown a power cutter assembly embodying the basic form of the invention. The cutter shown generally at reference numeral 1 is formed by the lamination of two frame members 2 and 3, bolted together by securing means 4 to form an integral unit. A separate upper jaw shown generally at 5 is made up of part 6 and 7 joined together by securing means 8 to form the upper jaw. The upper jaw 5 is mechanically linked to a handle 9 by means of a hinge coupler 10. The handle 9 is secured to frames 2 and 3 by means of pivot pin 11. The upper jaw 5 is secured to frame members 2 and 3 by means of pivot pin 12. A cutting blade 13 shown in broken line, has a front (cutting) edge 14 and back edge 15 and is movably positioned between frame members 2 and 3 within slot 16 shown in FIG. 3 extending along the length of the cutter 1. A fork-shaped lever 17 having a handle 18 and blade securing end 19 is secured at 19 to blade 13 at back edge 15 by securing means 20. A slot 21 on frame member 2 and 3, allows blade 13, securing means 20 and blade securing end 19 of lever 17 to be movable with respect to frame members 2 and 3. Hinge couplers **22*a* and 22*b* positioned on both sides of lever 17 couples lever 17 from pivot pins 23*a* and *b* to pivot pins 24*a* and 24*b* secured to frame members 2 and 3. Handle 9 and upper jaw 5 are attached to hinge coupler 10 by means of pivot pins 25 and 26** respectively.

Blade 13 can be slid along slot 16 within cutter 1, by pulling lever 17 backwards. The blade securing pin 20, blade 13 and blade securing end 19 of lever 17 will slide along slot 21 to the position shown by reference numerals **14*a*, 15*a*, 17*a*, 19*a* and 20*a***.

Hinge 22 allows for the non-linear rotational movement of lever 17 when cutting blade 13 is being moved.

Figure 4:
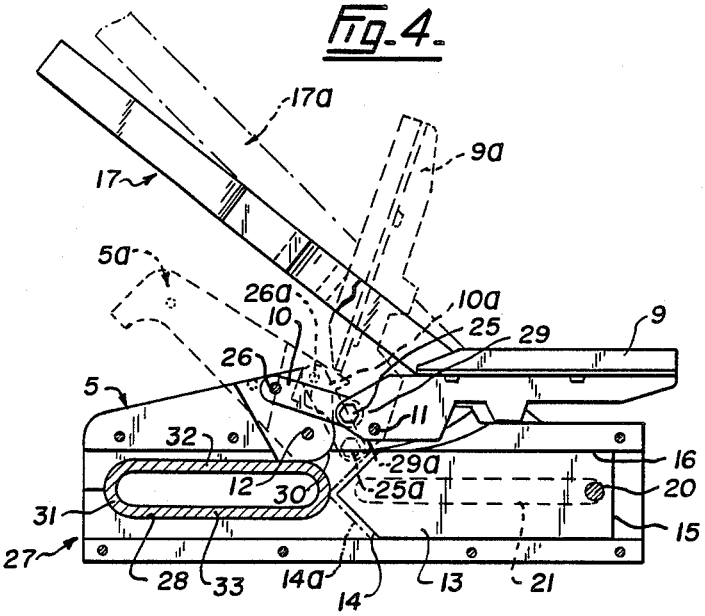
FIG. 4 is a front view showing the upper jaw open.

Referring now to FIG. 4, upon lifting handle 9 pivot pin 25 will rotate about pivot pin 11 in a counter-clockwise direction therefore pulling hinge coupler 10 down to allow pivot pin 26 to rotate about pivot pin 12 in a clockwise direction and hence raise upper jaw 5 to the position shown with broken lines and depicted by reference numerals **5*a*, 9*a*, 10*a*, 25*a*, 26*a***.

A cylindrical object such as a rubber hose 31 can then be inserted between upper jaw 5 and lower jaw 27 in opening 28. Lowering handle 9 will lower upper jaw 5 and hence collapse the inserted rubber hose 31 which will generally take the form of opening 28. The combination of the linkage from handle 9 to upper jaw 5 provides a powerful gripping action to collapse the hose, otherwise difficult to collapse by hand.

Figure 1:
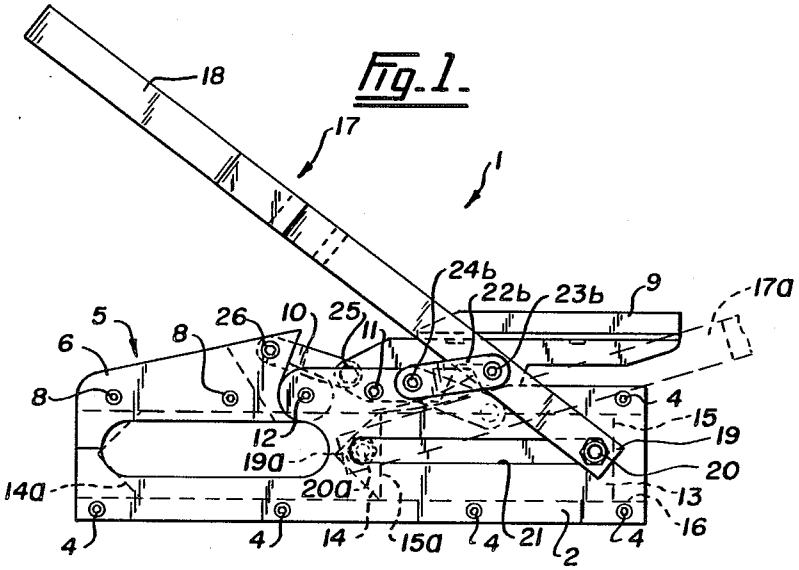
FIG. 1 is a front view of the power cutter disclosed in this invention.
Figure 2:
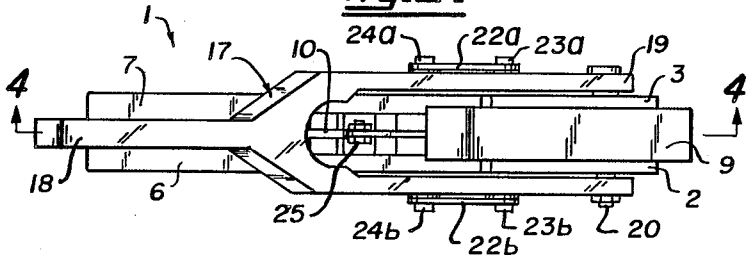
FIG. 2, is a top view of the power cutter.
Figure 6:
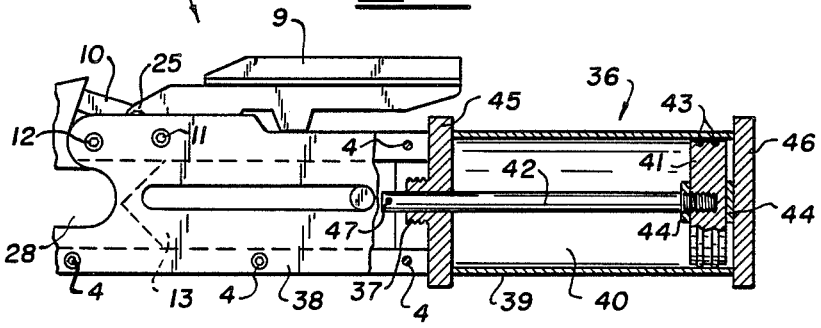
FIG. 6 is a front view of another embodiment of the invention.
Figure 5:
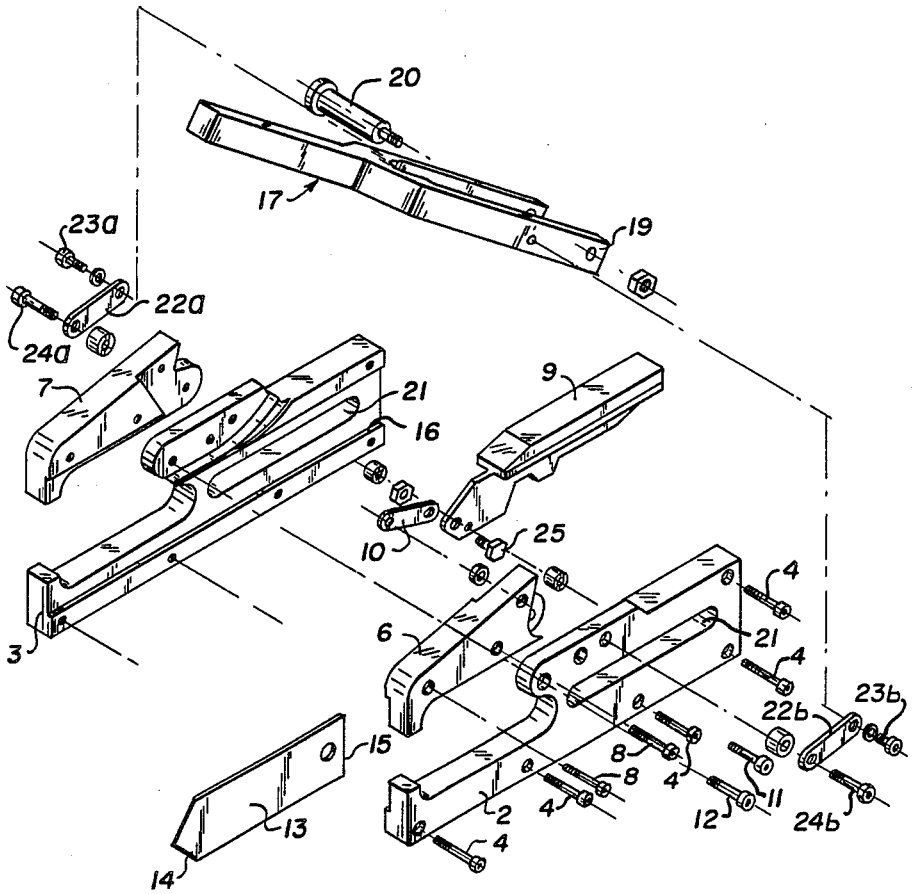
FIG. 5 is an exploded view of the power cutter.

The pre-collapsing of hose 31 builds a juxtaposition of upper and lower hose walls 32 and 33 respectively, creating a totally supporting cell. Hose 31 is ready to be cut once the upper and lower jaws, 5 and 27 respectively, collapses hose 31. Cutting of hose 31 can be accomplished either by manually activating lever 17, as shown in FIG. 1 or activating by means of pneumatic or hydraulic system as shown in FIG. 6. An important and novel aspect of this cutter is the fact that by pre-collapsing the hose 31 in the position shown in FIG. 4, the hose 31 is prevented from collapsing in the transverse direction when pressure is applied by the blade 13 upon penetrating a side of the hose 31. Also, upon penetration, cutting edge 14 will exert pressure upon the upper and lower walls 32 and 33, respectively, of the collapsed hose, holding these against upper and lower jaws 5 and 27, respectively, while these are being cut.

As seen in FIG. 4, a safety mechanism has been incorporated in the power cutter which will not allow the blade cutting action to be activated once upper jaw 5 is partially open, or at loading time. Blade 13 will not be movable into opening 28 when upper jaw 5 is in the open position **5*a*. We can see in FIG. 4 that, when hinge coupler 10 is fully lowered as shown at 10*a*, the bottom end 29 of coupler 10 extends below the slot line 16 thus preventing the cutting edge 14 of blade 13 from being projected through the slot out into opening 28. This is depicted by the relative movements of parts 14*b* and 17*b*. If a different coupling arrangement is used, the pivot base 30 of upper jaw 5 can be shaped so as to prevent blade 13 from being movable once jaw 5 is in the open position since the unslotted portion of pivot head 30 would block slot 16 and still prevent blade 13** from travelling in this slot.

The power cutter can be operated manually or automatically by use of hydraulically or pneumatically controlled pistons to move the blade and or activate the upper jaw. When manually operated, a side handle can also be provided to make holding of the cutter easier. The various parts of the cutter can be constructed by stampings for manual fabrication or injection molded. These parts can be made of various metal alloys as well.

If we now refer to FIG. 6, we have shown at reference numeral 35 the multi-cutter in which blade 13 is activated by a pneumatic or hydraulic system 36. As is well known in the art a pneumatic system can be powered by compressed air, compressed gas such as nitrogen or $CO_2$ gas. The pneumatic system is secured to cutter 1 by means of threads 37 on cutter body 38. The pneumatic system 36 is basically comprised of a cylinder 39 enclosing a cylinder chamber 40, a piston 41 secured to a piston rod 42. Piston 41 is provided with a pair of O-rings or cups 43 inhibiting the sealing of piston 41 within cylinder 39. A pair of piston bumper cushions 44 is also provided to dampen the contact of piston 41 with cylinder walls 45 and 46. Piston rod 42 is secured to blade 13 by means of a connecting pin 47. Other piston activating means will be known to those knowledgeable in this art and need not be discussed further.

I claim:

1. An apparatus adapted for cutting tubular objects comprising:

a main body;

cutting means movably positioned within said body;

first actuating means secured to said cutting means;

retaining means movable between an open position and a closed position and defining an area in which said objects are held before said cutting means;

second actuating means to permit opening and closing of said retaining means; and lock means to prevent said cutting means from moving into the area defined by said retaining means when said retaining means is in the open position, whereupon moving said retaining means into the closed position to secure said objects within said retaining means, allows said first actuating means to be activated thereby allowing said cutting means to cut said object.

2. An apparatus as defined in claim 1 wherein said cutting means comprises a cutting blade having a cutting edge and a back edge remote from said cutting edge, said cutting blade being recessed in said body and movable into the area defined by said retaining means upon activation of said first actuating means secured at the back edge of said blade.

3. An apparatus as defined in claim 2 wherein said cutting blade has an angle cutting edge pointed at its centre.

4. An apparatus as defined in claim 2 wherein said recessed blade is prevented from sideways movement when pressure is exerted on it by said first actuating means.

5. An apparatus as defined in claim 1 wherein said retaining means comprises a first and second retaining member, said first retaining member forming an integral part of said main body and said second retaining member being movable relative said first retaining member such that said tubular object can be secured between said retaining members upon activating said second actuating means.

6. An apparatus as defined in claim 1 wherein said tubular object is collapsed upon closure of said retaining means juxtaposing the upper and lower walls of said object, said walls being supported by said retaining means thus allowing said cutting means to cut said collapsed tubular object transversely of said object's longitudinal axis, without the further collapsing of said tubular object.

7. An apparatus as defined in claim 1 wherein said lock means forms an integral part of said retaining means.

* * * * *